United States Patent [19]

Brodie

[11] 3,969,025

[45] July 13, 1976

[54] WAX APPLICATING DEVICE

[76] Inventor: James A. Brodie, P.O. Box 1448, Lennoxville, Quebec, Canada, J0B 1Z0

[22] Filed: Jan. 20, 1975

[21] Appl. No.: 542,199

[52] U.S. Cl. ..... 401/2
[51] Int. Cl.[2] ..... A47L 13/32
[58] Field of Search ..... 401/1, 2; 222/146 HE; 118/410, 5, 75, 76, 77, 202

[56] References Cited

UNITED STATES PATENTS

| | | | |
|---|---|---|---|
| 686,461 | 11/1901 | Keats | 118/78 |
| 1,312,347 | 8/1919 | Ogden | 401/2 |
| 1,767,079 | 6/1930 | Kenyon | 401/1 |
| 1,967,443 | 7/1934 | Lay et al. | 401/1 X |
| 2,118,415 | 5/1938 | Pesark | 401/1 |
| 2,459,247 | 1/1949 | Skold | 118/76 X |
| 2,726,632 | 12/1955 | Asbeck et al. | 118/410 |
| 3,088,434 | 5/1963 | Sprague et al. | 118/410 |
| 3,204,828 | 9/1965 | Paulsen | 401/1 X |
| 3,853,410 | 12/1974 | Busoni | 401/1 |

*Primary Examiner*—John P. McIntosh

[57] ABSTRACT

A wax applicating device adapted for applying a coating of melted wax to the lower surface of skis, toboggans, or the like. The subject device avoids the problems normally associated with the application of solid wax to a surface of a ski, particularly at the skiing site. To achieve this, the subject invention provides a portable device adapted to apply a coating of melted wax to a surface to be waxed. The wax applicating device according to the subject invention comprises a holder adapted to receive a quantity of solid wax; a wax applicating head adapted to engage a surface to be waxed; and heater means operatively associated with the holder. The heater means is adapted to melt solid wax situated in the holder, whereby melted wax passes through an opening in the holder to the wax applicating head for application to a surface to be waxed.

9 Claims, 6 Drawing Figures

WAX APPLICATING DEVICE

BACKGROUND OF THE INVENTION

1. Field of the Invention

The subject invention relates generally to a wax applicating device, and, in particular, to such a device which is easily portable and is adapted to apply a coating of melted wax to the lower surface of skis, toboggans, or the like.

The application of wax to skis, especially at the site, is both a tedious and time consuming problem. For example, if solid wax is being used, the wax is difficult to apply and requires the application of sufficient force in order to spread the wax over the surface of the ski. Further, using solid wax, it is difficult to obtain a layer of wax of relatively uniform thickness over the surface of the ski. To render such a cold wax application effective, one has to vigorously rub the waxed surface of the ski with a hand held rubbing device (usually cork or styrene foam), or pass a hot iron over it. This is usually tedious and messy. Liquid waxes which are available are restricted in their range of use. Consequently they do not significantly ease the waxing problem.

2. Description of the Prior Art

Apparatus similar to that according to the subject invention have been utilized for applying a surfacing material such as wax over a floor. However, such apparatus are normally of more complicated structure than that according to the subject invention and could not be readily adapted for use in applying a coating of melted wax to the lower surface of a ski or toboggan. Accordingly, the subject invention proposes to provide an easily portable device adapted to apply a coating of melted wax to a surface to be waxed.

SUMMARY OF THE INVENTION

To achieve this, the wax applicating device according to the subject invention comprises: a holder adapted to receive a quantity of solid wax; a wax applicating head adapted to engage a surface to be waxed; and heater means operatively associated with the holder. The heater means is adapted to melt solid wax situated in the holder, whereby melted wax passes through an opening in the holder to the wax applicating head for application to a surface to be waxed.

BRIEF DESCRIPTION OF THE DRAWINGS

In drawings which illustrate embodiments of the invention according to the subject application.

BRIEF DESCRIPTION OF THE DRAWINGS

Figure 1:
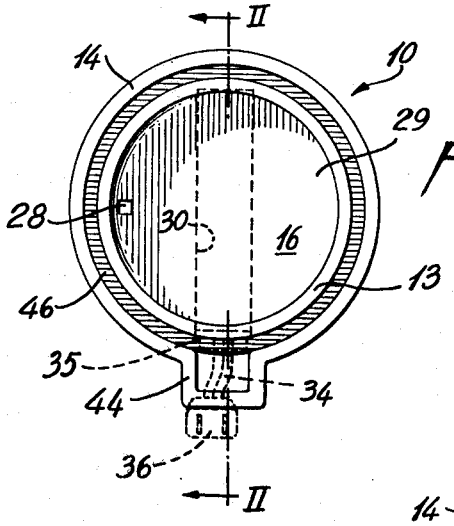
FIG. 1 is a plan view of one embodiment of the wax wax applicating device according to the subject invention.
Figure 2:
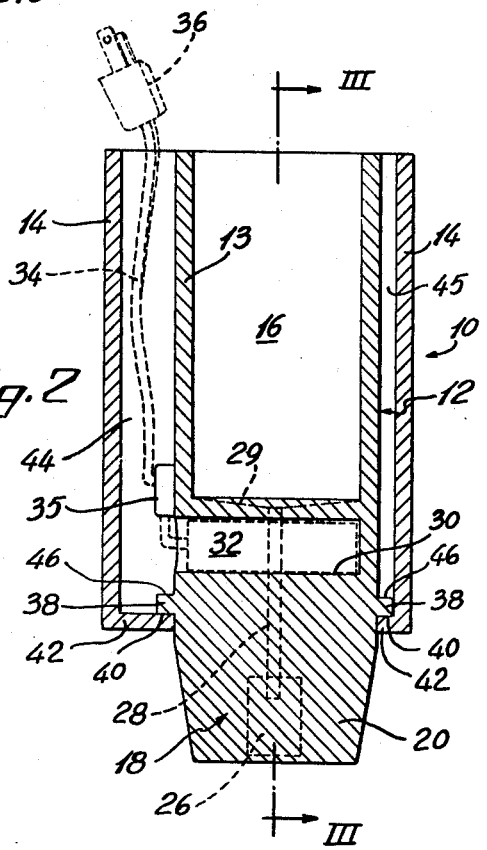
FIG. 2 is a vertical cross-section of the embodiment according to FIG. 1, taken along the line II—II.
Figure 3:
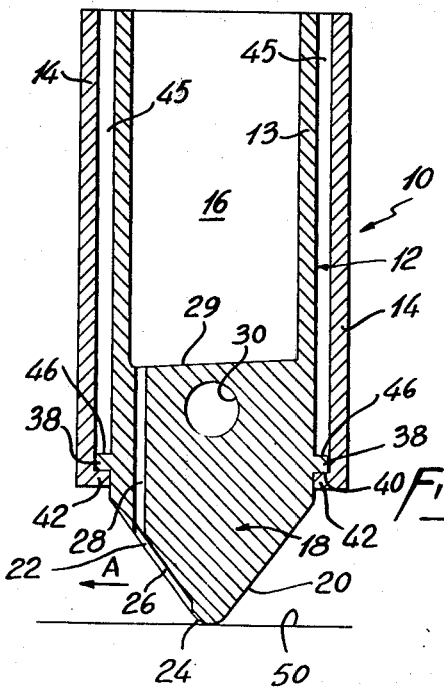
FIG. 3 is a vertical cross-section of the embodiment according to FIG. 2, taken along the line III—III.

In FIGS. 1 to 3, the embodiment of the wax applicating device according to the subject invention is designated generally by reference numeral 10. The device

10 includes two main components comprising an elongated central portion 12 and a gripping portion 14 which encloses a cylindrical sidewall 13 forming an upper section of the central portion 12. In this embodiment, the central portion 12 is of one-piece aluminum construction and the cylindrical sidewall 13 thereof forms a wax holder 16, the holder 16 having an open upper end adapted to receive a bar of wax which is to be applied to a surface to be waxed. The sidewall 13 can also be a separate component of the central portion 12 and be made from a heat resistant material, as in the embodiment according to FIGS. 4 and 5.

A lower section of the central portion 12 of the device comprises a wax applicating head 18 having two converging flat surfaces 20 and 22 which merge into a rounded nose portion 24 at the lowermost end of the head 18. The rounded nose portion 24 is adapted to permit the waxing of a longitudinal groove which extends along a lower surface of a ski. The flat surface 22 includes a shallow depression 26 which, in the embodiment of FIGS. 1 to 3, is substantially rectangular in plan view, the depression 26 being situated near the middle of the flat surface 22 and extending approximately one-third the width of the surface 22. The shape and width of the depression 26 can be varied, the width being of any suitable size which is less than the width of the surface 22. The function of the depression 26 is to direct the flow of melted wax along the surface 22 to the nose portion 24. Melted wax enters the depression 26 via a lower end of a conduit means 28 which communicates the wax holder 16 with an upper end of the depression 26. An upper end of the conduit means 28 terminates at a bottom surface 29 of the wax holder 16, the bottom surface 29 being tapered slightly downwardly from the sidewall 13 of the holder 16 to the upper end of the conduit means 28. The tapered bottom surface 29 directs the flow of melted wax within the wax holder 16 to the conduit means 28, thereby limiting accumulation of melted wax on the bottom surface 29 of the wax holder 16. While not shown in this embodiment of the invention, the conduit means 28 may include a valve so that a user can shut off the flow of melted wax from the holder 16 to the depression 26.

The lower section of central portion 12 of the device includes a transverse cylindrical bore 30 situated near the bottom surface 29 of the wax holder 16. The bore 30 is adapted to receive a heater means 32 therein, the heater means 32 being shown in phantom in FIG. 2. One heater means 32 which has been successfully utilized is a 50 watt, 120 volt cartridge electrical heater. The heater means 32 in FIG. 2 is provided with an extension cord 34 having an electric plug 36 for connecting the heater means 32 to an alternating current source of power.

The heater means 32 also includes a thermostat 35 by means of which the temperature of the wax holder 16 is maintained approximately between 225° and 250°F when the wax applicating device is in use. Further, while the embodiment of FIGS. 1 to 3 operates off of an alternating current source of power, the device according to the present invention can be easily adapted to permit its operation from a direct current source of power, e.g., by using an adapter which can be plugged into the holder for a cigarette lighter in an automobile. The latter arrangement would permit the wax applicating device to be used at the site from the power supplied by an automobile battery.

The lower section of the central portion 12 includes an outwardly extending annular shoulder portion 38 situated between the bore 30 and upper edges of the flat surfaces 20 and 22. A lower surface 40 of the shoulder 38 engages a cooperating upper surface of an inwardly extending flange portion 42 located at the lowermost end of the gripping portion 14. As best seen in FIG. 1, the gripping portion 14 is a cylindrical container having an open upper end and a bulge or channel portion 44 extending outwardly over a narrow portion of the circumference of the gripping portion, the bulge portion 44 also extending the height of the gripping portion 14 and adapted to provide sufficient space for a portion of the extension cord 34, as well as the thermostat 35. An inner surface of the gripping portion 14 is separated from an outer surface of the cylindrical sidewall 13 of the wax applicating portion 12 by an annular space 45 extending from an upper surface 46 of the annular shoulder 38 to the top of the device. The gripping portion 14 is made of a plastic, heat-resistant material, and is adapted to be gripped by a user of the device. To further limit heat transfer from sidewall 13 of wax holder 16 to the gripping portion 14, the annular space 45 may be filled with a suitable insulating material.

To operate the wax applicating device, solid wax is first inserted into the wax holder 16 of the device 10. The electric plug 36 is then inserted into a suitable alternating current receptacle, whereby the heater means 32 generates heat which is conducted by the aluminum central portion 12 to the bottom surface 29 of the wax holder 16. The heat generated by the heater means 32 is such that only the lower surface of the bar of wax within the holder 16 is melted. Melted wax within the wax holder 16 passes through the conduit means 28 to the depression 26. The wax applicating head 18 also receives heat by conduction from the heater means 32, thereby maintaining the melted wax passing from the holder 16, through the conduit means 28, to the rectangular depression 26 in its liquid form. To apply melted wax to a surface, the device is held in substantially a vertical position, such that melted wax entering the depression 26 flows downwardly therein to the nose portion 24 which is in contact with the surface 50 to be waxed. The device is advanced by the user in a direction facing the surface 22 as indicated by arrow A in FIG. 3, which is substantially at right angles to a length of the nose portion 24. As the device is advanced, melted was flows away from the area of the depression and a bead of melted wax is formed between the surface 50 and a leading edge of the nose portion, the bead extending the width of nose portion 24. Movement of the device in the reverse direction irons out irregularities in the wax which has just been deposited on the surface 50. To increase the flow of wax to the surface 50, the user simply applies pressure to an upper surface of the bar of wax situated within the wax holder 16, thereby forcing a greater area of the lower surface of the bar of wax against the heated bottom surface 29 of the holder 16, while simultaneously urging melted wax within the holder 16 through the conduit means 28.

The width of the rounded nose portion 24 of the device is a little more than the distance from an edge of the longitudinal groove situated at the centre of the lower surface of a ski to an adjacent longitudinal edge of the ski. Thus, wax is first applied to the surface on one side of the longitudinal groove and then to the surface on the other side of the groove. The groove itself is then waxed by advancing the rounded nose portion 24 along the length of the groove in a direction at right angles to arrow A in FIG. 3.

As noted above, only the lower surface of the bar of wax within the holder 16 is melted, the remainder of the bar of wax remaining cool and solid to facilitate its removal from the wax applicating device once the waxing of the surface is completed. The upper portion of the bar of wax is kept cool and solid in that the upper end of the device is completely open.

Figure 4:
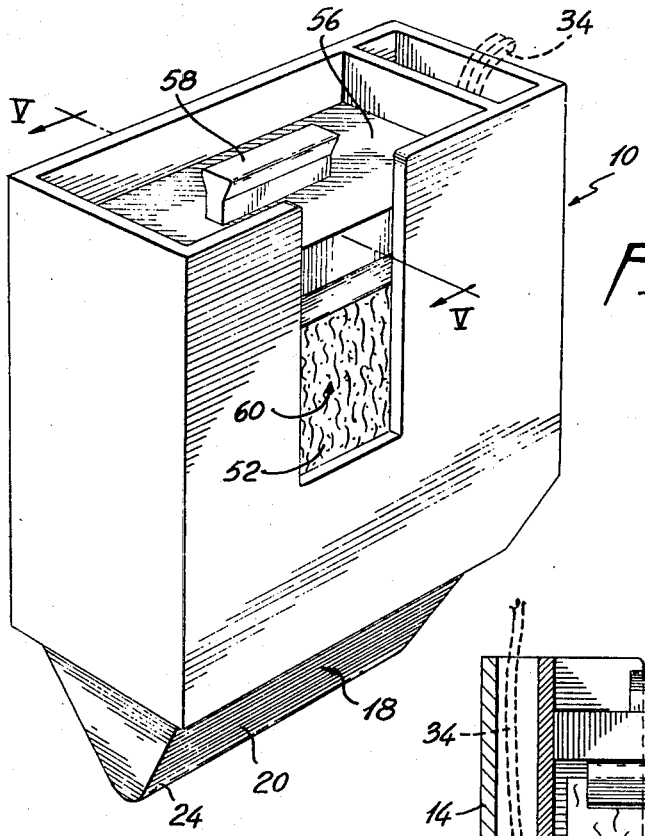
FIG. 4 is a perspective view of a further embodiment of the wax applicating device.
Figure 6:
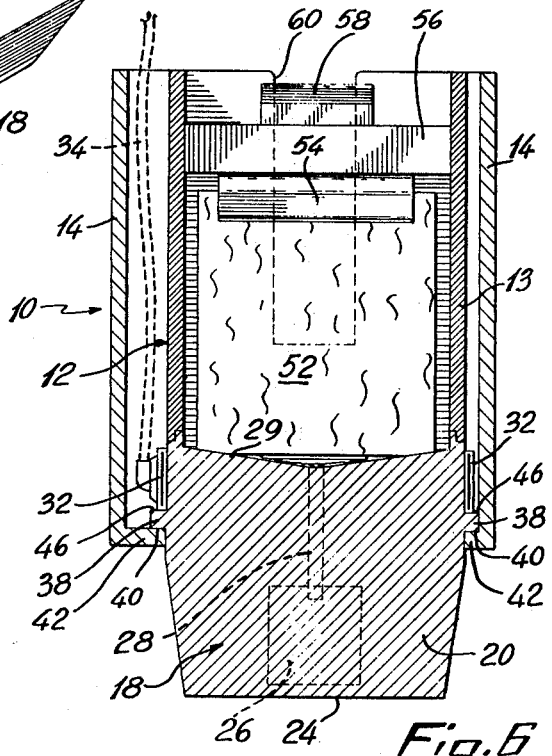
FIG. 6 is a vertical cross-section of a further embodiment of the wax applicating device.
Figure 5:
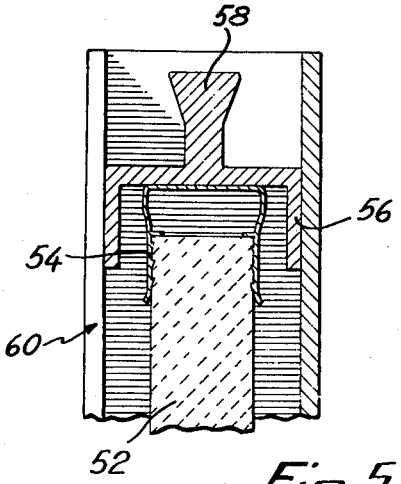
FIG. 5 is an enlarged vertical section taken along the line V—V of FIG. 4.

The embodiments of the invention according to FIGS. 4, 5, and 6 are quite similar to the embodiment of FIGS. 1 to 3, with similar component parts bearing the same reference numerals in all six figures. In the embodiments of FIGS. 4 to 6, the wax holder 16 is rectangular in plan view and the heater means 32 comprises a flat band heater which is wrapped around the wax applicating head 18 adjacent the bottom surface 29 of the wax holder 16. To facilitate mounting of the band heater, corners of the head 18 are rounded off. The use of the band heater avoids the necessity of providing a bore in the lower section of the central portion 12 for the cartridge-type heater means. In addition, in this embodiment, the sidewalls 13 of the holder 16 are constructed from a non-heat conducting material in order to prevent melting of sides of a bar of wax 52 situated within the holder.

Further, the bar of wax 52 shown in FIGS. 4 to 6 is gripped at its upper end by a clamp means 54 comprising a spring clamp which releasably supports the upper end of the bar of wax from a slider 56 to which the clamp means 54 is secured. The slider 56 is so dimensioned as to slide freely within the holder 16 while supporting the bar of wax away from the sidewalls 13 of the wax holder 16, thereby preventing clogging while providing a measure of neatness to the device which minimizes the amount of cleaning of the device which would otherwise be necessary. A handle 58 is mounted on the top of the slider 56, by means of which a user presses down on the top thereof, forcing the bar of wax downwardly in order to increase the flow of melted wax to the surface to be waxed, as described previously. A slot 60 is situated in a wall of the holder 16 in order to facilitate the application of pressure to the top of the handle, especially when the bar of wax within the holder 16 becomes smaller in size. The use of the slider 56 and clamp means 54 allows pressure to be applied to the wax without the user placing his fingers on the wax, thus providing a measure of safety and convenience. The slider and clamp means also facilitates the removal of the bar of wax from the wax holder after waxing is completed.

The type and location of the heater means used in association with the device can be modified from the embodiments shown without in any way departing from the invention according to the subject application. Thus, a rechargeable portable battery incorporated in the device could provide the necessary source of power. In addition, in the embodiment according to FIG. 6, only the lower section of the central portion 12 which includes the bottom surface 29 of the holder 16, as well as the wax applicating head 18, need be made of a heat conducting material such as aluminum. Thus, the sidewalls 13 are constructed from a non-heat conducting material which limits heat transfer to the gripping portion 14. Likewise, in FIGS. 4 and 5, the sidewalls of the wax holder are made of a non-heat conducting material and, in this embodiment, function as the gripping portion of the device.

Further, while the embodiments of FIGS. 1 to 6 utilize a conduit means between an opening in the holder and the wax applicating head, it is within the scope of the subject invention to construct the wax applicating device such that an opening in the holder would permit the discharge of melted wax directly to the wax applicating head. For example, in such an embodiment, a portion of the wax holder would extend outwardly beyond an upper edge of the outer surface of the wax applicating head. An opening in the bottom surface of the holder would be situated adjacent a location where the upper edge of the outer surface meets the holder, whereby melted wax flows directly from the holder to the outer surface of the wax applicating head. At least one depression could be provided in the outer surface of the applicating head in order to direct the flow of melted wax flowing from the opening in the bottom surface of the holder to the lower edge of the wax applicating head which would be in contact with the surface being waxed.

As a further modification of the embodiments of FIGS. 1 to 6, one end of the rounded nose portion of the wax applicating head is flattened over a width of approximately three-eighths of an inch in order to facilitate the waxing of longitudinal grooves situated in the lower surfaces of skis which are substantially rectangular, as opposed to curved, in cross-section. The device would then be advanced along the rectangular groove with the flattened portion of the wax applicating head lying against the base of the groove.

I claim:

1. A portable wax-applicating device for manually applying a thin coat of wax on the running surface of skis or the like, comprising: a wax-holder having a bottom surface and comprising a compartment for holding a piece of solid wax to be progressively melted at its inner end at the bottom surface; a gripping portion circumposed in insulated relation about said wax-holder for accommodating the hand of a user as wax is melted and applied to a running surface;

a wax-applicating head of a heat-conducting material depending from said wax-holder and gripping portion;

heater means on the wax-applicating head adjacent the bottom surface of the wax-holder for concentrating heat where the wax is melted at the inner end of the wax being melted, and maintaining the wax-applicating head at a temperature for applying liquid wax and ironing the wax into a thin layer after it has been applied, said applicator head including internal conduit means communicating with the bottom surface of the wax-holder for receiving melted wax, said applicator head having a substantial width defined by two convergent faces extending the width of the applicator and terminating in a lower transverse edge, said conduit means opening into one of the faces which one face comprises an application face when the melted wax discharges onto the one face and is applied as a thin coat the width of the applicator head when the device is moved in one direction, said other face comprising an ironing face for ironing a thin layer of the melted wax as the device is moved in an opposite direction, said transverse edge comprising means for forming a liquid head of melted wax between the respective faces and the surface upon which the wax is applied.

2. The structure as claimed in claim 1 in which said gripping portion and wax-holder include a lateral channel formed therebetween, and current-conducting means disposed in said channel and connected to said heater means for energizing the same.

3. The structure as claimed in claim 2 in which said gripping portion comprises an upwardly-opening element including a lower, inwardly-directed flange, said wax-holder including an intermediate shoulder resting on said inwardly-directed flange and beyond which said applicator head projects the inner surface of said gripping portion and outer surface of said wax-holder being spaced to provide an insulating space.

4. The structure as claimed in claim 2 in which said heater means comprises an electrical heater cartridge mounted in a bore in the wax-applicating head below the bottom surface of the compartment and connected to the current-conducting means in said channel.

5. The structure as claimed in claim 2 in which said heater means comprises an electrical band heater, circumposed about said wax-applicating head and connected to said current-conducting means.

6. The structure as claimed in claim 1 in which said lower transverse edge is arcuate transversely between said surfaces so that the transverse arcuate edge will be substantially tangent to the surface on which wax is being applied.

7. The structure as claimed in claim 6 including a recess in the one face wax is discharged from said internal conduit means for facilitating melted wax flow to the transverse arcuate edge to form the liquid head.

8. The structure as claimed in claim 1 in which a slider is slidably mounted within said wax-holder, said slider including clamp means for releasably supporting a bar of wax so that the bar of wax is progressively melted only at its lower inner end and can be readily removed from the wax-holder.

9. The structure as claimed in claim 8 in which said wax-holder includes an upwardly-opening slot at which clamp means is exposed and accessible to facilitate the application of manual pressure or removal of the bar of wax.

* * * * *